US007832624B2

(12) United States Patent
Kong

(10) Patent No.: US 7,832,624 B2
(45) Date of Patent: Nov. 16, 2010

(54) DRAWER TYPE PACKING BOX

(75) Inventor: Seung-oh Kong, Gyeonggi-do (KR)

(73) Assignee: Hanjin Printing & Chemical Co., Ltd., Seoul (KR)

( * ) Notice: Subject to any disclaimer, the term of this patent is extended or adjusted under 35 U.S.C. 154(b) by 254 days.

(21) Appl. No.: 12/094,487

(22) PCT Filed: Sep. 25, 2006

(86) PCT No.: PCT/KR2006/003787

§ 371 (c)(1),
(2), (4) Date: May 21, 2008

(87) PCT Pub. No.: WO2008/032889

PCT Pub. Date: Mar. 20, 2008

(65) Prior Publication Data

US 2008/0308615 A1 Dec. 18, 2008

(30) Foreign Application Priority Data

Sep. 16, 2006 (KR) ..... 10-2006-0089861

(51) Int. Cl.
*B65D 5/38* (2006.01)

(52) U.S. Cl. ..... 229/125.125; 206/1.5; 229/913

(58) Field of Classification Search ..... 229/125.125, 229/913, 122, 125.12, 129.1; 206/267, 536, 206/1.5

See application file for complete search history.

(56) References Cited

U.S. PATENT DOCUMENTS 625,757 A * 5/1899 Groneman ..... 229/125.125
1,511,328 A * 10/1924 Goodman ..... 229/125.125
2,318,655 A * 5/1943 Zalkind ..... 229/913
2,470,270 A * 5/1949 Srofe ..... 229/125.125
3,823,864 A * 7/1974 Ohkubo ..... 229/125.125

(Continued)

FOREIGN PATENT DOCUMENTS

JP 59007128 A 1/1984

(Continued)

OTHER PUBLICATIONS

Patent Abstracts of Japan, Publication No. 2003-312641 dated Nov. 6, 2003, 1 page.

(Continued)

*Primary Examiner*—Gary E Elkins
(74) *Attorney, Agent, or Firm*—Osha • Liang LLP

(57) ABSTRACT

A pull type packing box comprises inner and outer containers. The outer container is a tube type box for receiving the inner container like a drawer. The outer container is provided with handles and performs the function of a shopping bag. As the outer container partially exposes a head portion of the inner container, a user can grasp the head portion to open the inner container, and information about an article can be printed on the exposed head portion. The strength of the mouth part of the outer container is increased so that the mouth part does not bend and the outer appearance of the packing box is not deteriorated. The outer container generates appropriate frictional force so that the drawer is not excessively opened and closed. The outer container includes a stopper for preventing the drawer from being separated from the outer container when opening the inner

5 Claims, 7 Drawing Sheets

U.S. PATENT DOCUMENTS

| | | | | |
|---|---|---|---|---|
| 3,949,928 | A * | 4/1976 | Perkins | 229/125.125 |
| 5,088,599 | A * | 2/1992 | Mahler | 229/125.125 |
| 6,412,636 | B1 * | 7/2002 | Jones et al. | 229/125.125 |

FOREIGN PATENT DOCUMENTS

| | | |
|---|---|---|
| JP | 6-53422 | 7/1994 |
| JP | 08-002519 | 1/1996 |
| JP | 2003-312641 | 11/2003 |
| JP | 2004-307060 | 11/2004 |

OTHER PUBLICATIONS

Patent Abstracts of Japan, Publication No. 08-002519 dated Jan. 9, 1996, 1 page.

International Search Report issued in PCT/KR2006/003787 mailed on Jun. 5, 2007, 2 pages.

esp@cenet English translation of the Abstract for Japan Publication No. JP-59007128 (A); publication dated: Jan. 14, 1984 (1 page).

Notice of Refusal Ground (Examination report) issued Sep. 27, 2007, by the Korean Intellectual Property Office in related-Korean Patent Applicaton No. 10-2006-0089861, with English translation (6 pages).

Notice of Allowance issued Jan. 2, 2008, by the Korean Intellectual Property Office in related Korean Patent Application No. 10-2006-0089861, with English translation (4 pages).

* cited by examiner

[Fig. 1]
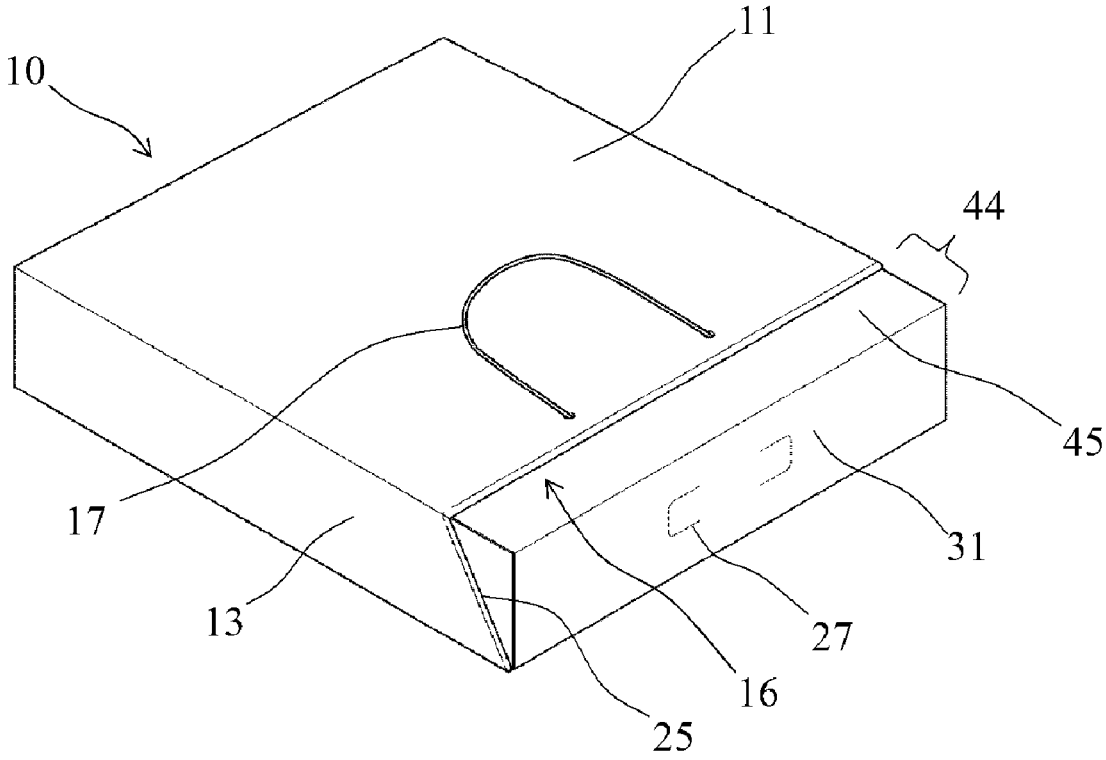

[Fig. 2]
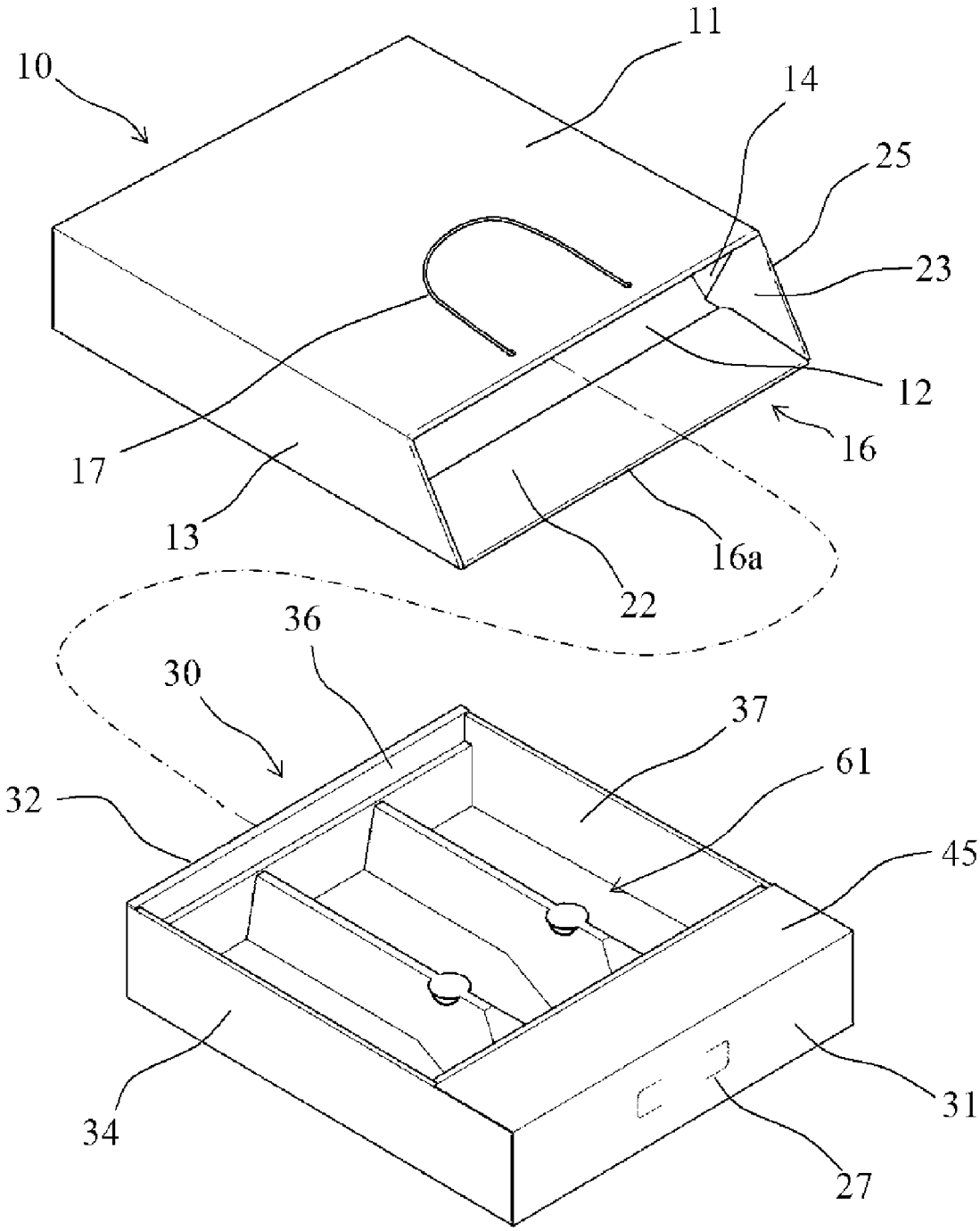

[Fig. 3]
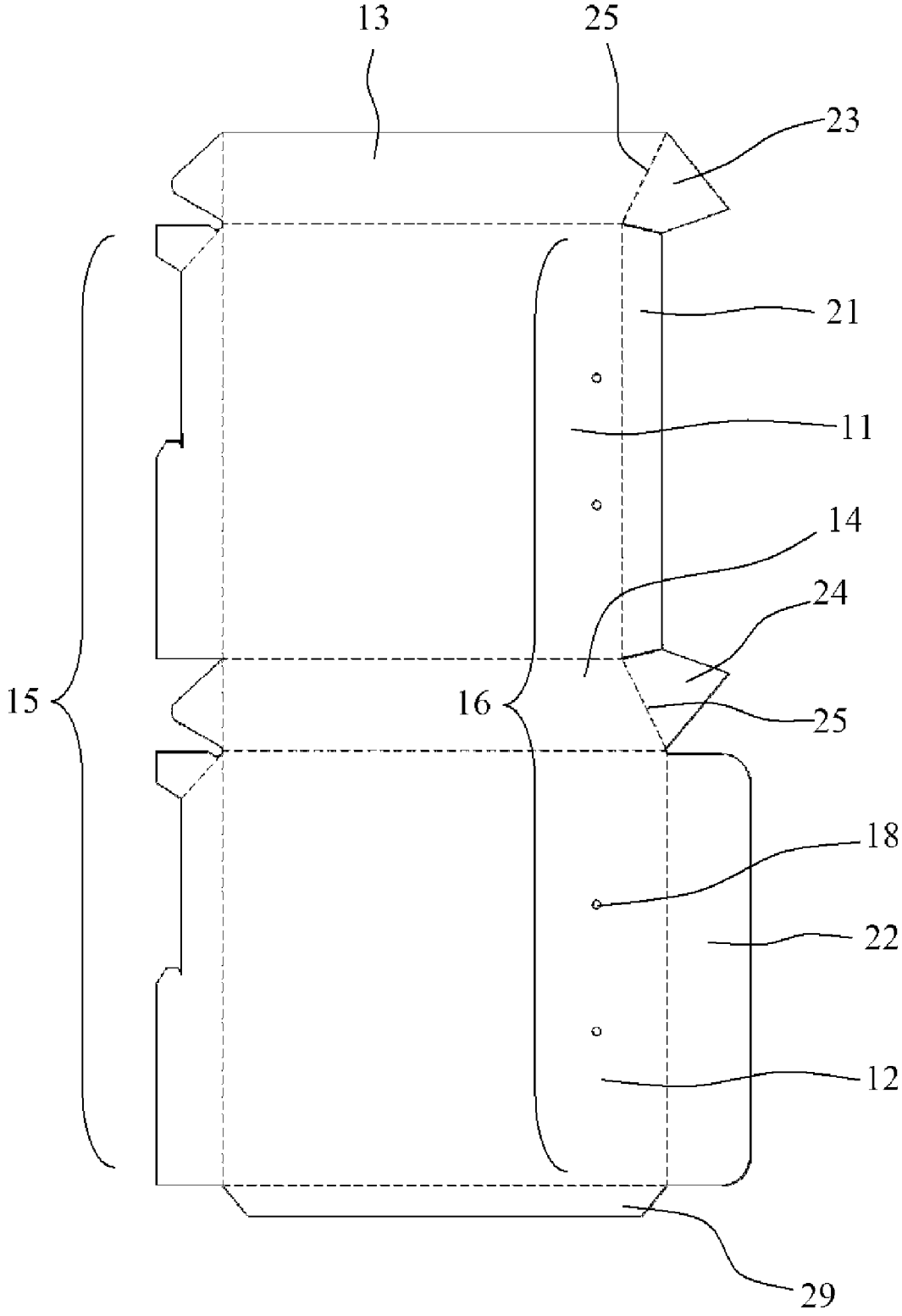

[Fig. 4]
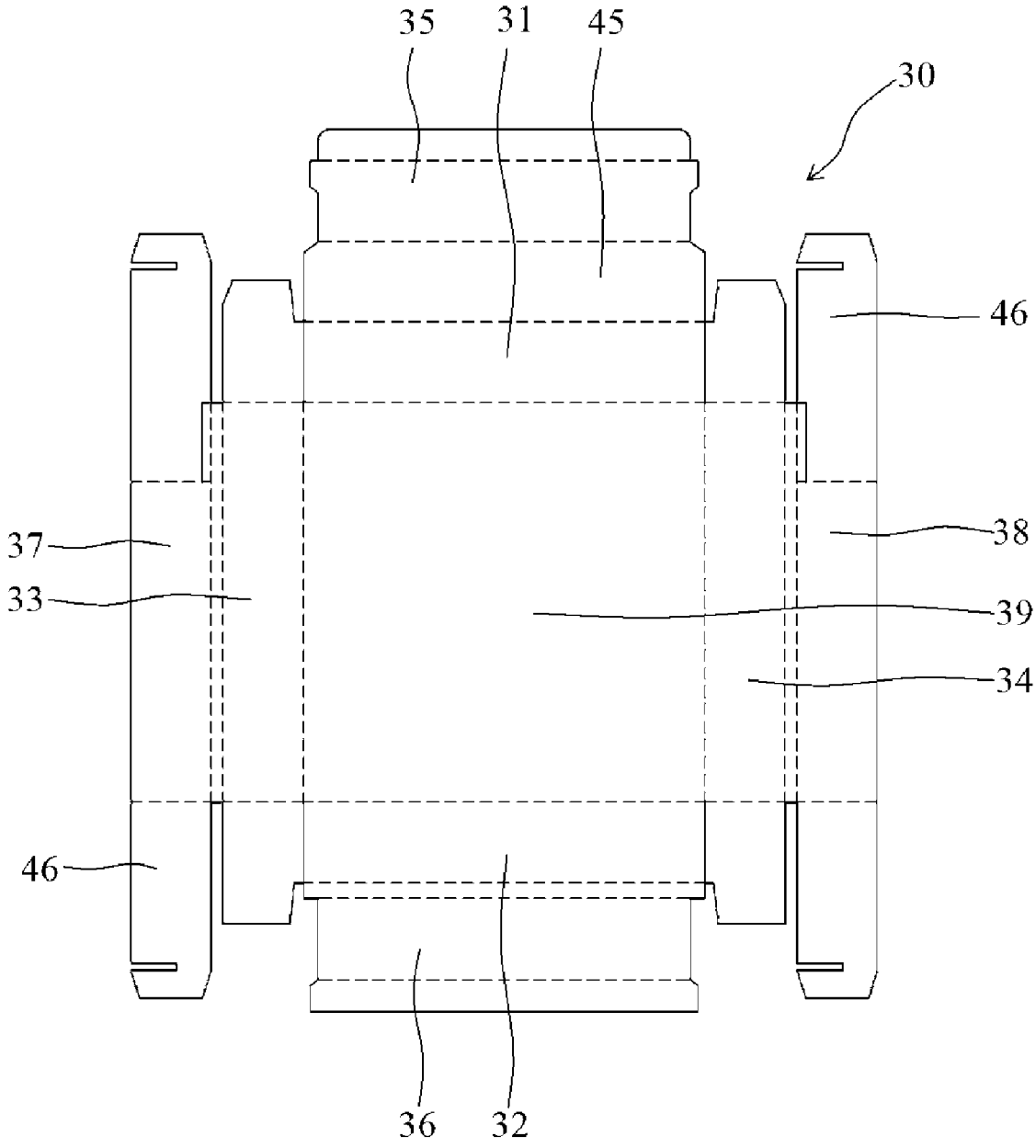

[Fig. 5]
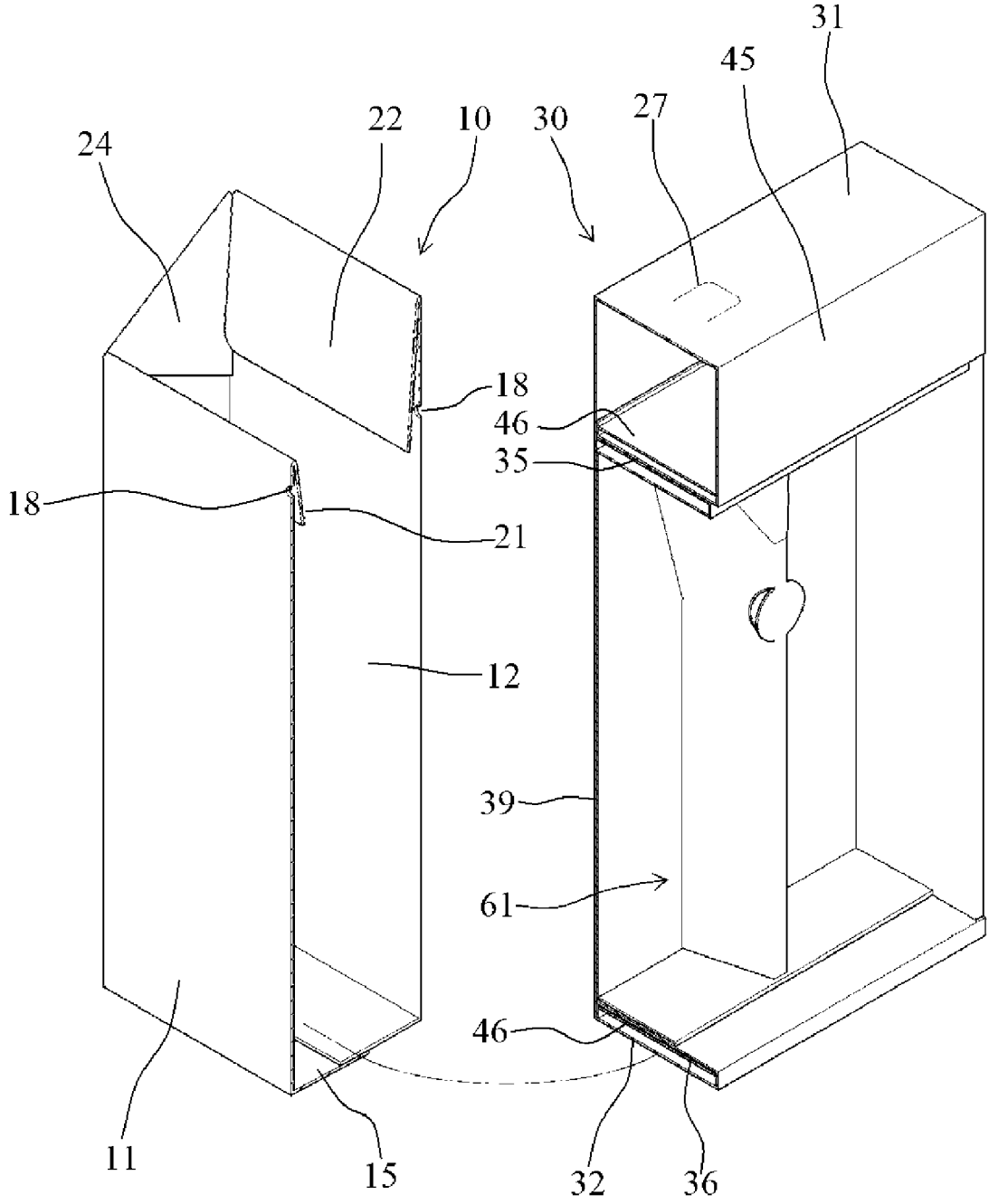

[Fig. 6]
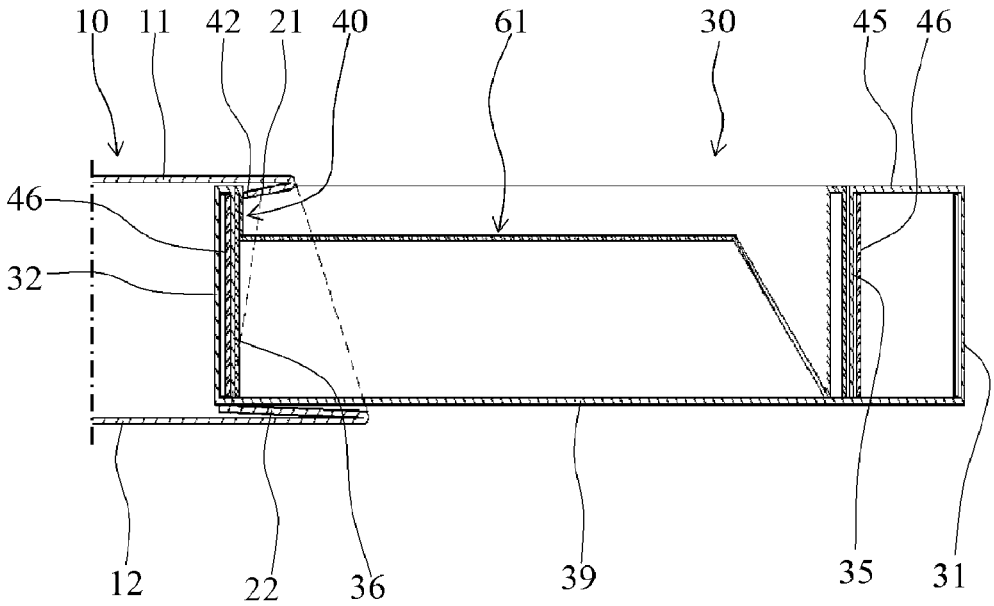
[Fig. 7]
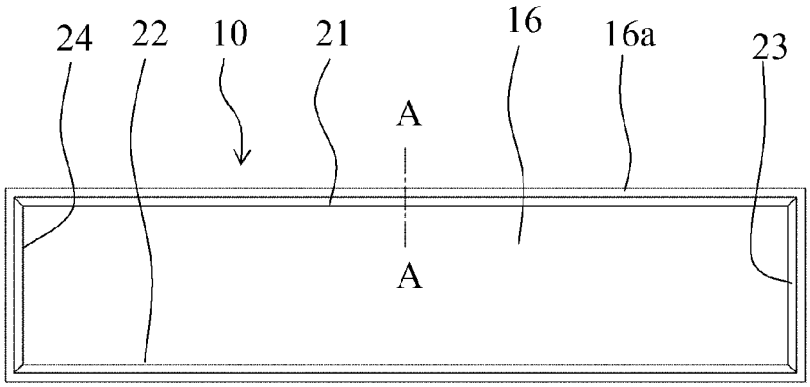
[Fig. 8]
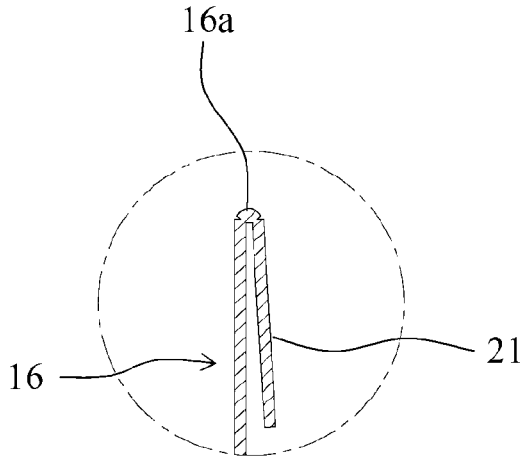

[Fig. 9]
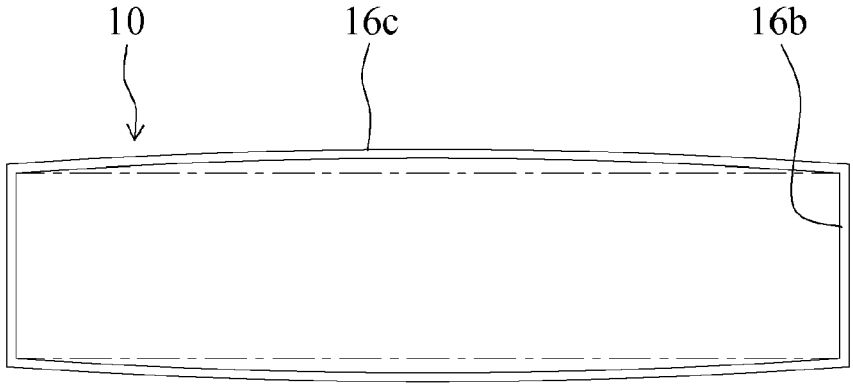
[Fig. 10]
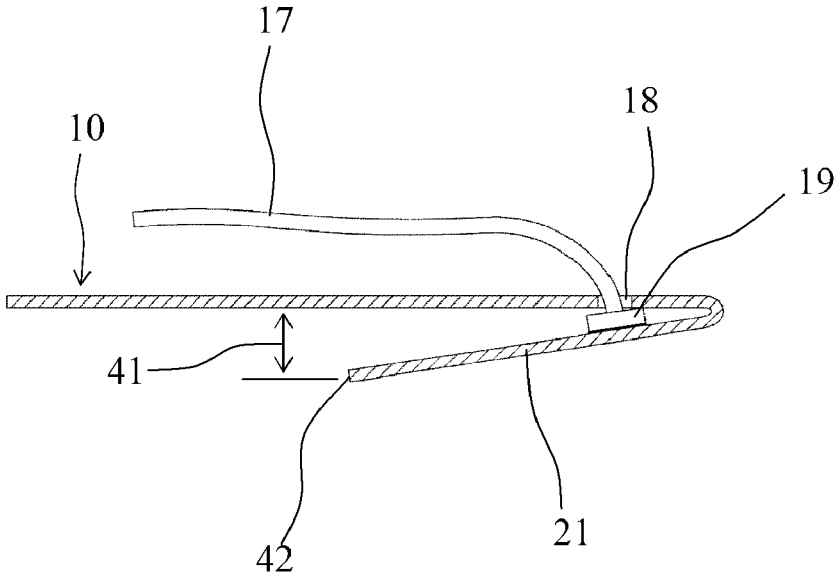
[Fig. 11]
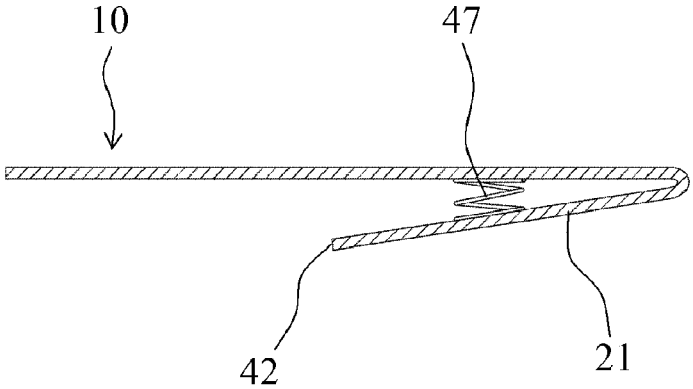

DRAWER TYPE PACKING BOX

TECHNICAL FIELD

The present invention relates, in general, to a pull type packing box, and more particularly, to an article packing box which comprises an inner container and an outer container, the inner container being assembled with the outer container in a drawer arrangement, and the outer container serving as a shopping bag.

BACKGROUND ART

As is generally known in the art, a conventional packing box is manufactured by forming a developed box using paperboard to include four continuous wall parts, segments of an upper wall part and segments of a lower wall part, shaping the four wall parts by pasting together two ends of the developed box, assembling the segments of the upper and lower wall parts, and providing handles to the assembled box or providing a knob to the paperboard.

Describing the functionality of the packing box, an article producer packs an article in a packing box and conveys the packed article to an article seller. The seller displays the packed article in a store, and conveys the packed article to a purchaser in the state in which it is received in a shopping bag. The purchaser opens the box containing the purchased article, and takes out and uses the article. The lifetime of most packing boxes and shopping bags ends when the packed boxes are opened.

In most areas, it is stipulated by law that a purchaser must separately buy a shopping bag. Devices for reducing the burden on purchasers due to the requirement to buy the shopping bags have been disclosed in the art. Packing boxes which also serve as a shopping bag include a packing bag and packing boxes described in Korean Utility Model Registration Nos. 20-231423, 20-352935 and 20-352938.

A packing box provided with handles allows a purchaser to save the cost of buying a shopping bag and provides the social benefit of conserving resources. However, in most packing boxes, including those having handles, once a packing box packing an article is transmitted to a customer, the use of the packing box is completed, and the packing box is removed from the article and is discarded.

The present invention has been made in an effort to provide a pull type packing box which extends the functionality of an article packing box and the benefits obtained therefrom.

DISCLOSURE OF INVENTION

Technical Problem

Articles produced by article producers are individually packed and placed on the market, selected and purchased by purchasers, transported in the state of being held in shopping bags, and used in accordance with the desires of the purchasers. One of the great concerns to which article producers pay attention is how the article placed on the market is competitively sold to the customers. In order for an article to be competitive, it is necessary to design the article so that the article can undergo communication with a purchaser in order to be selected by the purchaser. This communication procedure may be referred to as a conversation between the article and the customer. The conversation, which the article conducts with the customer through the medium of packaging, is a primary conversation, which is based on the quality, efficacy and price of the article. In addition, a secondary conversation is conducted via the service which is provided by the packing of an article while the customer purchases and uses the article. It has been found that the secondary conversation strongly influences the sale of an article. That is to say, when the quality and cost of articles produced by two article producers are equal to each other, when the secondary consideration included in one article is known to customers, the market share of that product is greatly increased. The concerns of article producers and sellers are concentrated on this secondary consideration, which serves as a strong basis for urging a customer to select an article.

In the present invention, the substance of the secondary conversation is considered to be to improve the elegance of the article, to provide convenience to a purchaser, to save material, to ensure practicality to a user, and to maintain the elegance of the article throughout the complete period of use of the article.

The present invention functions to include in a packing box a conversation medium which directly influences the perception of articles by purchasers and arouses the purchasers' interest in the articles. The present invention discloses a pull type packing box as a purchase promotion medium included in a packing box. In the present invention, the pull type packing box indicates a packing box capable of maintaining the function of a drawer for a period during which an article is completely used. The pull type packing box does not mean packaging in which an article is taken out through a single operation of opening a drawer. The pull type packing box according to the present invention comprises a combination of an outer container and an inner container. The present invention provide a packing box in which the outer container performs a function of a shopping bag and obviates the need for a separate shopping bag. The present invention provides a packing box in which the inner container can be opened and closed with respect to the outer container just like a drawer. The present invention provides a packing box in which the inner container is not separated from the outer container during the drawer-like operation of the inner container. The present invention provides a packing box in which remaining portions of an article are kept in good order in the drawer while a portion of the article is used and the quality of the article is maintained to its end. The present invention provides a packing box in which the strength of the mouth part of the outer container is reinforced and the outer appearance of the packing box is not deteriorated.

Technical Solution

In a paperboard packing box, four upper, lower, left and right wall parts, a front wall part, a rear wall part, corner parts, a junction part, tying parts for maintaining the box in a folded state, and other overlapping parts are formed from flat paperboard having the shape of a developed box. By folding the corner parts and pasting the junction part, the shape of a normal box is formed. The paperboard packing box is manufactured in a manner such that the four wall parts, the front wall part and the rear wall part can be held in a collapsed state. The paperboard packing box is distributed in the collapsed state, and is folded in the shape of the normal box when packing an article.

The present invention, which includes novel features and working effects for providing convenience and additional services to an article purchaser or a user so as to serve as a communication medium between an article and the purchaser, is manufactured from a developed box using the above manufacturing method.

A pull type packing box according to the present invention comprises an inner container and an outer container. The outer container of the present invention is a tube type box for receiving the inner container in the form of a drawer. The outer container is provided with handles and performs the function of a shopping bag. As the outer container partially exposes the head portion of the inner container, a user can grasp the head portion using one hand to open the drawer, which is the inner container, and information about an article can be printed on the exposed head portion. The strength of the mouth part of the outer container, through which the inner container is received in the outer container, is increased so that the mouth part does not bend and has a straight form and so that the outer appearance of the packing box does not deteriorate. The outer container generates appropriate frictional force so that the drawer does not freely open and close. In particular, the outer container includes a stopper for preventing the drawer from being separated from the outer container when opening the drawer, that is, the inner container. Also, the rear wall part is formed to be folded so that the packing box can be provided to an article producer with upper and lower wall parts brought into contact with each other in a collapsed state, and the article producer can fold the collapsed outer container into the normal shape of a quadrangular tube and receive the inner container into the outer container.

The inner container of the present invention is received in the outer container and is stably opened and closed like a drawer throughout the period for which the article is used. An article support for supporting the article in a displayed state is accommodated in the inner container. The inner container has an upward projection so that the stopper of the outer container can be brought into contact with the upward projection to prevent separation of the drawer. A grip part through which the inner container can be grasped with the fingers is provided to the touch part of the inner container, which is exposed outside of the outer container. In addition, perforated lines are formed in the inner container so that the fingers can be inserted into the inner container by tearing the perforated lines.

Hereafter, the present invention will be described in further detail with reference to the attached drawings of embodiments thereof.

A pull type packing box in accordance with an embodiment of the present invention comprises an outer container 10 and an inner container 30. The outer container 10 is manufactured by integrally forming four wall parts 11, 12, 13 and 14, a rear wall part 15, and a junction part 29 from paperboard, folding the flat paperboard in the shape of a quadrangular tube, and pasting the junction part 29. The outer container 10, which is formed in the shape of a tube, has a mouth part 16 through which the inner container 30 can be received in the outer container 10 just like a drawer. Handles 17 are provided to the outer container 10 adjacent to the mouth part 16 to allow the outer container 10 to perform a function of a shopping bag.

The inner container 30 is manufactured in the shape of a quadrangular container by integrally forming the component elements of the inner container 10, including four outer wall parts 31, 32, 33 and 34, four inner wall parts 35, 36, 37 and 38, a bottom wall part 39, and tying parts 46, from flat paperboard, folding the flat paperboard into the shape of a box, and connecting the tying parts 46 with each other. An article support 61 for displaying at least one article is accommodated in the quadrangular container. The inner container 30 can be inserted through the mouth part 16 of the outer container 10 such that it can be opened and closed like a drawer. With the inner container 30 closed, the inner end of the inner container 30 comes into contact with the rear wall part 15, and with the inner container 30 opened, the upward projection 40 of the inner container 30 comes into contact with the stopper 42 of the outer container 10.

In the present invention, as the inner container 30 is opened and closed like a drawer with respect to the outer container 10, when initially using an article, the drawer is opened and some of the contents are taken out. Then, with the drawer closed, since the packing box has an attractive initial outer appearance, the packing box can be maintained in an initial state throughout the period during which the article is completely used. The effect of the drawer-like packing box of the present invention allows an article user to use the remainder of the contents just like a newly purchased article throughout the period for which the article is used. Throughout the period for which the article is used, the remaining parts of the article can be easily kept in good order, and the operations for opening and closing the box can be easily and conveniently conducted. These benefits serve as an information medium for arousing purchasers' interest in a store. Also, in the pull type packing box of the present invention, due to the fact that the packing box is cleanly preserved throughout the period during which the article is completely used, the image of an article is ameliorated. Further, the benefit of enhancing the article advertisement effect through the printed medium of the packing box is rendered to an article producer and a seller.

Mouth overlapping parts 21, 22, 23 and 24 for reinforcing the strength of the mouth part 16 are formed by extending and inwardly bending the four wall parts of the outer container 10 at the mouth part 16, through which the inner container 30 is received in the outer container 10. As shown in FIGS. 7 and 8, as the mouth overlapping parts 21, 22, 23 and 24 cause the edge 16*a* of the mouth part 16 of the tube-shaped outer container 10 to have a rounded surface, a smooth outer appearance is provided. Moreover, as the strength of the mouth part 16 is reinforced due to the presence of the rounded edge 16*a*, the contour of the mouth part 16 is aesthetically appealing, thus elevating the quality of the article, and as the cut edge of the paperboard is hidden, it is possible to prevent a finger from being cut by the sharp cut edge of the paperboard. In this regard, referring to FIG. 9, if the cut edge 16*b* of the paperboard is exposed to the outside in the mouth part 16 of the outer container 10, the outer appearance of the packing box is deteriorated, and the strength of the mouth part is weakened, as a result of which bent portions are formed in the mouth part and the quality of the article is degraded. Also, the finger of the user may be cut by the sharp cut edge of the paperboard.

The mouth overlapping part 21, which is one of the mouth overlapping parts, is elastically detached from the upper wall part 11 of the outer container 10 to define a gap 41, and the free end of the mouth overlapping part 21 serves as a stopper 42, which is brought into contact with the upward projection 40 of the inner container 30 when the inner container 30 is opened. The upward projection 40 of the inner container 30, which is brought into contact with the stopper 42, is formed by the rear wall part of the inner container 30. In order to properly maintain the drawer-like operation of the inner container 30, it is necessary to prevent the unintentional separation of the drawer from the outer container 10. In the present invention, since the stopper 42 is detached from the upper wall part 11 of the outer container 10 to define the gap 41, even when the inner container 30 is sufficiently opened, because the stopper 42 is brought into contact with the upward projection 40 of the inner container 30, the unintentional separation of the inner container 30 is prevented. The inner container 30 of the packing box according to the present invention which includes this provision can be stably opened and closed, just like a drawer.

In the present invention, inclined parts 25 are formed at both sides of the mouth part 16 of the outer container 10. Due to the presence of the inclined parts 25, with the drawer closed, a touch part 44 of the inner container 30 is exposed outside of the outer container 10. In order to form the touch part 44, a grip part 45 is formed between the parts 31 and 35 of the inner container 30. The touch part 44 is exposed to the outside, irrespective of whether the drawer is opened or closed. The touch part 44 formed by the grip part 45 allows the inner container 30 to be grasped by fingers when opening the drawer. Further, the grip part 45 can be utilized as a medium for providing information about the article.

Perforated lines 27 for the insertion of fingers are formed in the outer wall part 31 of the inner container 30. The perforated lines 27 can be replaced with a knob serving as equivalent means. By inwardly pressing the perforated lines 27, a user can define openings for permitting the insertion of fingers to open and close the drawer. If the openings are defined or the knob is provided to the inner container 30, in a state in which the grip part 45 is grasped by inserting the fingers through the openings or using the knob, the drawer can be opened and closed, whereby the opening and closing operation of the drawer can be conducted in a convenient manner.

The three remaining mouth overlapping parts 22, 23 and 24 are also detached from the corresponding wall parts of the outer container 10 and are brought into elastic contact with the inner container 30 to prevent unimpeded opening and closing operation of the inner container 30. The three remaining mouth overlapping parts 22, 23 and 24 function to reinforce the strength of the mouth part 16 of the outer container 10 as described above, and generate frictional force for allowing the drawer to be stably operated. This delicate function stimulates the purchase determination tendency of repetitive purchasers of the packed article to which the present invention is applied.

Referring to FIG. 10, each of the handles 17 provided to the outer container 10 is constructed in a manner such that each head portion 19 is inserted through a hole 18, which is defined in the outer container 10, to be retained around the hole 18 on the inner surface of the outer container 10. The head portions 19 of the handle 17 function to maintain the gap 41 between the stopper 42 and the outer container 10. In FIG. 11, a mechanical element for applying elasticity to permit proper operation of the stopper 42 is provided. The mechanical element comprises a spring 47 disposed between the mouth overlapping part 21 and the outer container 10. In FIG. 10, the material elasticity of the head portions 19 of the handle 17 allows the mouth overlapping part 21 to operate in the same manner as shown in FIG. 11. Therefore, in the present invention, the stopper 42 ensures stable and convenient operation of the drawer, that is, the inner container 30.

With the outer container appropriately placed on a piece of furniture, the article can be taken out and used by opening and closing the drawer, and the packing box of the present invention can serve as a drawer of the piece of furniture during the period for which the packing box is kept in place for the use of the article.

Advantageous Effects

As is apparent from the above description, the present invention provides a packing box having a drawer function which can be used as a means of arousing article purchasers' interest. The pull type packing box of the present invention comprises a combination of outer and inner containers. The outer container serves as a shopping bag. The inner container can be stably opened and closed with respect to the outer container, as in the operation of a drawer. In the pull type operation, the inner container does not become separated from the outer container. While some articles are used, remaining articles are preserved in the inner container, that is, a drawer, so that the initial quality of the remaining articles can be kept as it is. As the strength of the mouth part of the outer container is reinforced, the outer appearance of the pull type packing box is not deteriorated.

BRIEF DESCRIPTION OF THE DRAWINGS

FIG. 1 is a perspective view illustrating a pull type packing box in accordance with an embodiment of the present invention;

FIG. 2 is an exploded perspective view illustrating the outer and inner containers of the pull type packing box in accordance with the embodiment of the present invention;

FIG. 3 is a development view of the outer container according to the present invention;

FIG. 4 is a development view of the inner container according to the present invention;

FIG. 5 is a broken-away perspective view illustrating the inner and outer containers according to the present invention;

FIG. 6 is a cross-sectional view illustrating the assembled state of the outer and inner containers according to the present invention;

FIG. 7 is a front view illustrating the mouth part of the outer container according to the present invention;

FIG. 8 is a cross-sectional view taken along line A-A of FIG. 7;

FIG. 9 is a front view illustrating a state in which the mouth part is deformed with overlapping parts removed from the mouth part of the outer container;

FIG. 10 is a cross-sectional view illustrating a handle which elastically biases a stopper; and FIG. 11 is a cross-sectional view equivalent to FIG. 10.

BEST MODE FOR CARRYING OUT THE INVENTION

The embodiment of the present invention is presented in the following examples 1 through 7.

Mode for the Invention

Example 1

Manufacture of Outer Container

As shown in FIG. 3, a developed box was produced such that the four wall parts 11, 12, 13 and 14, the rear wall part 15 and the junction part 29, which are the components of the outer container 10, the mouth overlapping parts 21, 22, 23 and 24 for the mouth part 16 of the outer container 10, the stopper 42, which is formed at the end of the mouth overlapping part 21, and the inclined parts 25, which are formed at both sides of the mouth part 16 of the outer container 10, are included in a flat paperboard. Then, by folding the components of the developed box along boundary lines and pasting the junction part 29, the outer container 10 was manufactured.

Example 2

Manufacture of Inner Container

As shown in FIG. 4, a piece of flat paperboard was prepared such that the outer wall parts 31, 32, 33 and 34, the inner wall parts 35, 36, 37 and 38, the bottom wall part 39, and the tying parts 46 are included in the flat paperboard. Then, by folding the flat paperboard and assembling the tying parts 46, the inner container 30 was manufactured.

Example 3

Fitting of Handles

The handles 17 were fitted through the outer container 10 adjacent to the mouth part 16.

Example 4

The Article Support 61 was Received in the Inner Container 30 of Example 2

Example 5

Assembly of Inner and Outer Containers and Function of Stopper

The inner container 30 of Example 4 was fitted into the outer container 10 of Example 3.

With the packing box closed, the inner end of the inner container 30 came into contact with the rear wall part 15 of the outer container 10, and with the packing box open, the upward projection 40 of the inner container 30 was brought into contact with the stopper 42 of the outer container 10.

Example 6

Forming of Perforated Lines for Insertion of Fingers

The perforated lines 27 for the insertion of fingers were further formed in the outer wall part 32 of the inner container 30 of Example 2.

Example 7

Function of Mouth Overlapping Parts

The ends of the mouth overlapping parts 22, 23 and 24 for the three faces of the mouth part 16 of the outer container 10 of Example 1 were detached from the outer container 10 and were brought into elastic contact with the inner container 30. This elastic contact produced frictional force and prevented the free opening and closing of the inner container 30.

INDUSTRIAL APPLICABILITY

As a result of the present invention, a pull type packing box for testing, which could be immediately used, was prepared. The features of the pull type packing box for testing were incorporated into the pieces of developed paperboards of FIGS. 3 and 4.

The invention claimed is:

1. A pull type packing box suitable for packing an article, manufactured by cutting a paperboard in the shape of a developed box, folding corners of the developed box, and pasting connection parts, the packaging box comprising:

an outer container having four wall parts (11, 12, 13 and 14) and a rear wall part (15) which form the shape of a quadrangular tube, defining a mouth part (16) through which an inner container (30) is inserted like a drawer, and possessing handles (17) provided adjacent to the mouth part (16) to perform the function of a shopping bag;

the inner container (30) having four outer wall parts (31, 32, 33 and 34), four inner wall parts (35, 36, 37 and 38) and a bottom wall part (39) which form the shape of a quadrangular container, accommodating an article support (61) for displaying at least one article, and inserted through the mouth part (16) of the outer container (10) to be opened and closed like a drawer;

mouth overlapping parts (21, 22, 23 and 24) formed by extending and inwardly bending the four wall parts of the outer container (10) at the mouth part (16) of the outer container (10) through which the inner container (30) is inserted, for reinforcing strength of the mouth part (16);

a stopper (42) formed by a free end of one mouth overlapping part (21) of the mouth overlapping parts, and elastically detached from an upper wall part of the outer container (10) to define a gap (41), so that the stopper (42) can be brought into contact with an upward projection (40) of the inner container (30) when the inner container (30) is opened; and the upward projection (40) formed by the rear wall of the inner container (30) to be brought into contact with the stopper (42) of the outer container (10).

2. The pull type packing box as set forth in claim 1, further comprising:

inclined parts (25) formed at both sides of the mouth part (16) of the outer container (10);

a touch part (44) formed on the inner container (30) and exposed outside of the outer container (10) due to presence of the inclined parts (25), even when the inner container (30) is closed; and a grip part (45) connected with edges of the outer and inner wall parts (31 and 35) of the inner container (30) to form three sides of a rectangular tube , wherein the grip part (45) forms the touch part (44) exposed outside of the outer container (10).

3. The pull type packing box as set forth in claim 1, wherein perforated lines (27) for insertion of fingers are formed on the front outer wall part (31).

4. The pull type packing box as set forth in claim 1, wherein three remaining mouth overlapping parts (22, 23 and 24) are detached from the corresponding wall parts of the outer container (10) and are brought into elastic contact with the inner container (30) to suppress excessive opening and closing operations of the inner container (30).

5. The pull type packing box as set forth in claim 4, wherein each of the handles (17) has two head portions (19), each of which is inserted through a hole (18) which is defined in the outer container (10), to be retained around the hole (18) on an inner surface of the outer container (10), and functions to maintain the gap (41) between the stopper (42) and the outer container (10).

* * * * *